United States Patent [19]

Aoki

[11] 4,399,731

[45] Aug. 23, 1983

[54] APPARATUS FOR AUTOMATICALLY COMPOSING MUSIC PIECE

[75] Inventor: Eiichiro Aoki, Hamamatsu, Japan

[73] Assignee: Nippon Gakki Seizo Kabushiki Kaisha, Hamamatsu, Japan

[21] Appl. No.: 405,144

[22] Filed: Aug. 4, 1982

[30] Foreign Application Priority Data

| | | | |
|---|---|---|---|
| Aug. 11, 1981 | [JP] | Japan | 56-125603 |
| Aug. 24, 1981 | [JP] | Japan | 56-132493 |
| Aug. 24, 1981 | [JP] | Japan | 56-132494 |
| Oct. 5, 1981 | [JP] | Japan | 56-158437 |

[51] Int. Cl.[3] ..... G10H 1/00

[52] U.S. Cl. ..... 84/1.03; 84/470 R

[58] Field of Search ..... 84/1.01, 1.13, 3, 453, 84/464 R, 470 R, 471 R, 484, DIG. 6, DIG. 23, 1.03

[56] References Cited

U.S. PATENT DOCUMENTS

| | | | |
|---|---|---|---|
| 4,208,938 | 6/1980 | Kondo | 84/1.03 |
| 4,294,154 | 10/1981 | Fujisawa | 84/1.01 |
| 4,350,068 | 9/1982 | Suzuki et al. | 84/1.01 |
| 4,353,278 | 10/1982 | Adachi et al. | 84/1.01 |
| 4,354,413 | 10/1982 | Suzuki et al. | 84/1.01 |
| 4,355,559 | 10/1982 | Uya et al. | 84/1.01 X |

*Primary Examiner*—L. T. Hix
*Assistant Examiner*—Derek Jennings
*Attorney, Agent, or Firm*—Spensley, Horn, Jubas & Lubitz

[57] ABSTRACT

An apparatus for automatically composing a music piece is provided by comprising a memory preliminarily storing plural kinds of pitch data. From this memory, at-random extraction is made of those pitch data agreeing with predetermined music conditions, and they are timewisely successively delivered out to be imparted durations, respectively, to form a composition data consisting of plural sets of pitch data and duration data amounting two to four measures to make a music piece. This composition data may be used for generation of music sounds, and/or display of music score image on a screen of a CRT device, and/or printing-out of a score by a printer, to be utilized in the sound-dictation training and/or performance exercise in providing, for example, musical education.

17 Claims, 11 Drawing Figures

APPARATUS FOR AUTOMATICALLY COMPOSING MUSIC PIECE

BACKGROUND OF THE INVENTION (a) Field of the Invention

The present invention concerns an apparatus for automatically composing a music piece, which is suitable for such purpose as composing music pieces for the sake of sound-dictation training, i.e. solfeggio, and/or performance exercise including rhythm-beating exercise.

(b) Description of the Prior Art

In providing musical education, sound-dictation (musical dictation) training and performance exercise including rhythm-beating exercise are being practiced widely. In practicing sound-dictation training, in general, the teacher first plays a short piece of theme music of two to four measures, and then the teacher asks the pupils to orally denominate the notes of this theme music or to take a dictation of the music on a music score sheet. Also, when exercising a performance, the teacher distributes to each of the pupils printed short pieces of theme music, and asks them to play based on the printed music scores.

Theme musics which are used in such sound-dictation training or performance exercise as mentioned above, in the past, have been composed by the teacher per se, or instead fractional phrases of existing music compositions have been utilized.

In case, however, the composition of theme musics is entrusted with a teacher, there has been entailed by the problem that, owing to the difference in composing ability among individual teachers, musically superior theme musics cannot always be obtained. Also, in case a fractional phrase of an existing music composition is utilized, there has been the problem that the room for the selection of music pieces becomes narrow and that the theme music per se tends to become uniformal.

SUMMARY OF THE INVENTION

It is, therefore, a primary object of the present invention to provide an apparatus for automatically composing music pieces, which is capable of automatically composing theme music pieces for use in sound-dictation training or performance exercise in providing, for example, musical education.

Another object of the present invention is to provide an apparatus of the type as described above, which is capable of composing melodies of a very modern style without the tendency to incline toward a certain fixed individual character nor the tendency to narrow the room for selecting music style in obtaining theme music pieces, and which, therefore, is quite suitable for making an automatic composition of theme musics for use in, for example, sound-dictation training or performance exercise.

Still another object of the present invention is to provide an apparatus of the type as described above, which allows the user to select, at will, the musical level of the piece of music to be composed, from an easy grade up to an advanced grade, in accordance with the level of the acquired skill of the pupil or the user, or in compliance with the school year of the pupil, and which allows the user to freely obtain such melody that represents the user's inclination and yet is devoid of predeterminability.

Yet another object of the present invention is to provide an apparatus of the type as described above, which is capable of combining a rhythm with a melody consisting of a non-predeterminable pitch arrangement to form a music composition of a desired number of measures.

A further object of the present invention is to provide an apparatus of the type as described above, which is capable of forming composition data by combining random duration data with random pitch data conforming to predetermined musical conditions.

DETAILED DESCRIPTION OF THE PREFERRED EMBODIMENTS

Figure 1A:
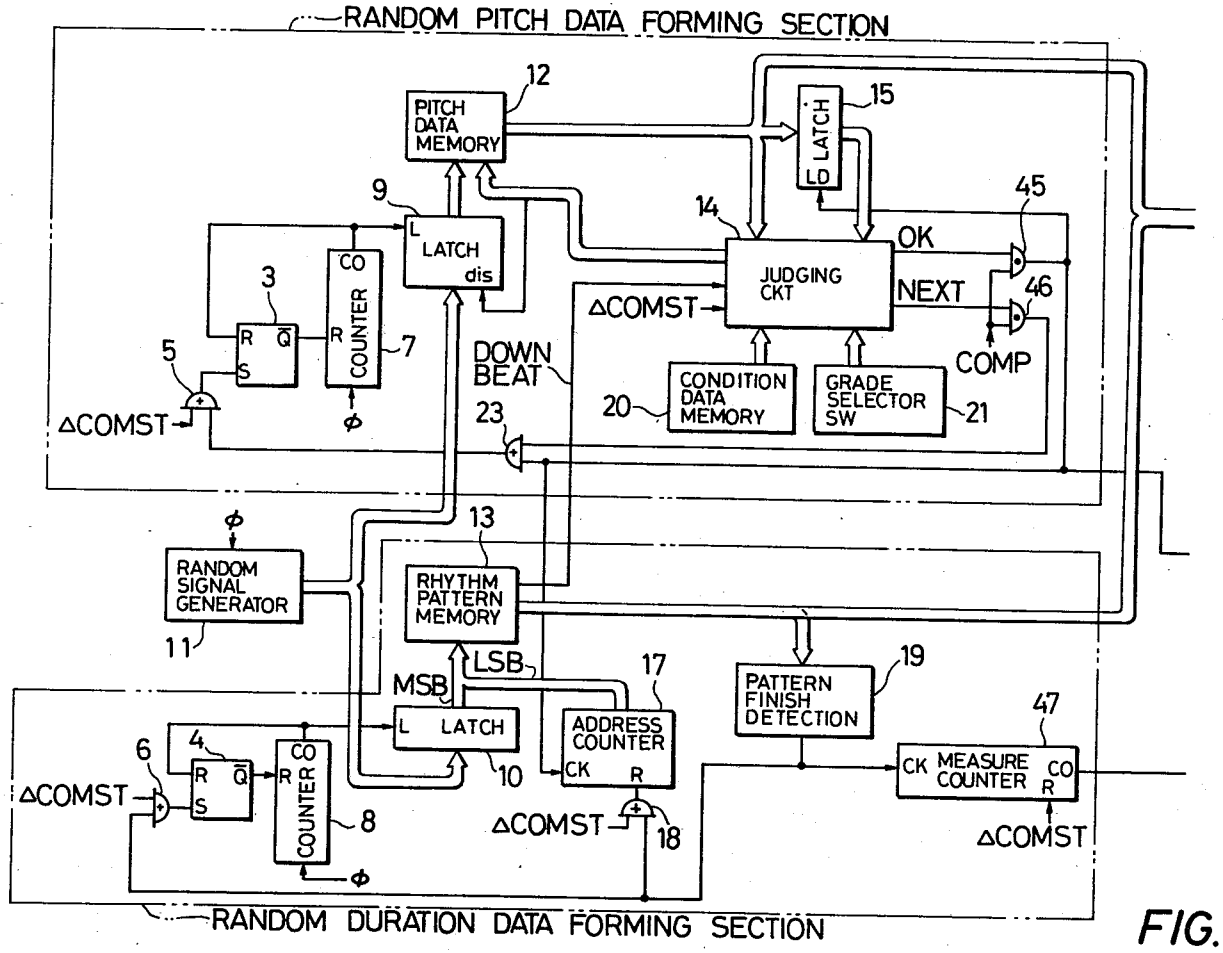
FIGS. 1A and 1B are, in combination, a block diagram showing an electrical structure of an embodiment of the apparatus for automatically composing a music piece according to the present invention.
Figure 1B:
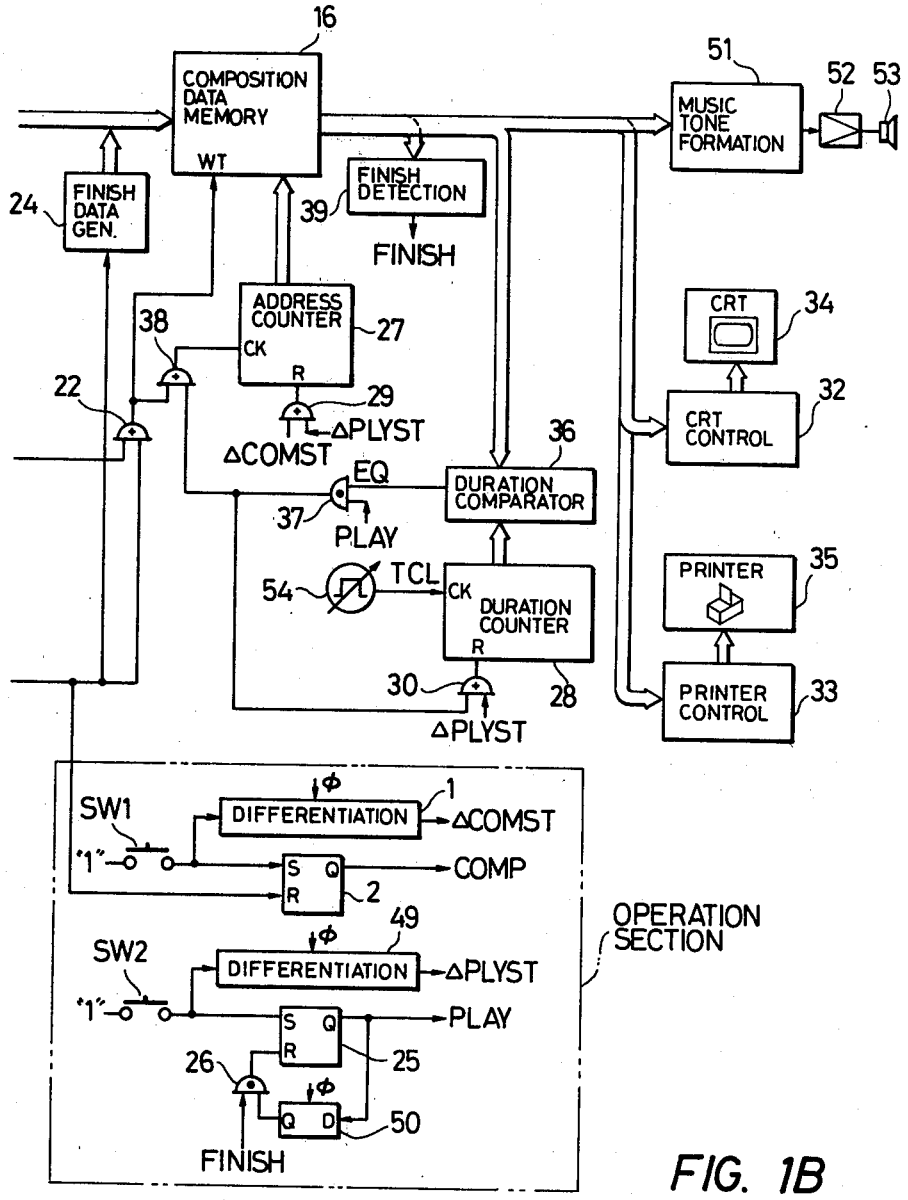

FIGS. 1A and 1B are, in combination, a block diagram showing the overall arrangement of an embodiment of the apparatus for automatically composing a music piece according to the present invention.

The apparatus shown in this embodiment has two operation modes consisting of a composing mode and a playing mode. In the composing mode on the one hand, as will be described in detail later, a predetermined composing operation is carried out based on the respective data read out from a pitch data memory and a rhythm pattern memory, and the composed music piece data is stored in a composition data memory. In the playing mode on the other hand, an automatic performance is carried out by a loudspeaker based on the music composition stored in the composition data memory, and, at the same time therewith, this piece of composition is displayed, as a music score, on a screen of a CRT (Cathode Ray Tube) device, and furthermore the music score corresponding exactly to this piece of composition is printed out by a printer on, for example, a sheet carrying music score lines (staves).

Thus, in case a sound-dictation training is intended to be practiced at the place of musical education, it is only necessary to first carry out the operation of the above-said composing mode, and then to have pupils listen to the piece of composition by utilizing the automatic performance function of the apparatus, and to confirm the result of the pupils' aquisition level either on the score lines displayed or on the printed records manifested on the sheet of the printer.

Also, in case it is intended to have pupils exercise a performance, it is only necessary to first carry out the operation of the composing mode in a similar manner as described above, and to print out the composed piece of music by using the printer, and to deliver the prints to the pupils to have them play the music piece based on the printed music score.

Next, description will be made of the operations of the respective modes mentioned above, starting with the composing mode.

In order to carry out a composing mode operation, the first step is to turn on a composition start switch $SW_1$. Whereupon, in response to the rise of a level "1" pulse resulting from the turn-on of the switch $SW_1$, there is outputted a "1" pulse of a very narrow width (hereinafter to be referred to as ΔCOMST) from a differentiating circuit 1. Concurrently therewith, by virtue of the rise of "1", the output of an RS flip-flop 2 (hereinafter this output will be referred to as COMP) is also set to the "1" level.

As an output ΔCOMST "1" and an output COMP "1" are delivered out in this way, the inverted Q outputs of RS flip-flops 3 and 4 are set to "0" via OR circuits 5 and 6, respectively. By virtue of these "0" outputs, counters 7 and 8 are relieved of their reset state, and begin to advance their count in timed pace with a system clock pulse $\phi$.

The counters 7 and 8 have been preliminarily set with predetermined maximum count values, respectively. Upon arrival at these maximum count values, their carryout outputs CO are delivered out as "1" pulses, respectively. These carryout outputs are supplied, as load signals, to latching conduits 9 and 10, respectively. Concurrently therewith, by virtue of these carryout outputs CO, the RS flip-flops 3 and 4 are reset, and their inverted Q outputs are rendered to "1" level, so that the counters 7 and 8 are reset and cease the advancement of their count.

To the input sides of the respective latching circuits 9 and 10 is supplied random numerical data outputted from a random signal generator 11. The random signal generator 11 is constructed of, for example, a shift register which behaves as a maximum length counter. From this random signal generator 11 is outputted random numerical data successively in timed sequence with the system clock pulse $\phi$.

Thus, when the carryout outputs CO of the counters 7 and 8 are supplied to the load terminals L of the respective latching circuits 9 and 10 as stated above, an identical numerical data is latched in each of the latching circuits 9 and 10.

Then, the numerical data latched in the respective latching circuits 9 and 10 are utilized in addressing a pitch data memory 12 and a rhythm pattern memory 13, respectively. However, description will be made first of the addressing operation at the pitch data memory 12.

Figure 2:
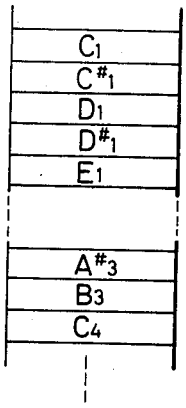
FIG. 2 is a memory map provided in a pitch data memory shown in FIG. 1.

In respective addresses of the pitch data memory 12 are stored plural kinds of pitch data with such predetermined codes as shown in FIG. 2. Accordingly, when a given numerical data is latched in the latching circuit 9 in such manner as stated above, there is read out, from the pitch data memory, only one pitch data which has been stored in that particular address corresponding to this numerical data. And, this pitch data thus read out is supplied, in parallel, to a judging circuit 14, a latching circuit 15 and a composition data memory 16.

Figure 3:
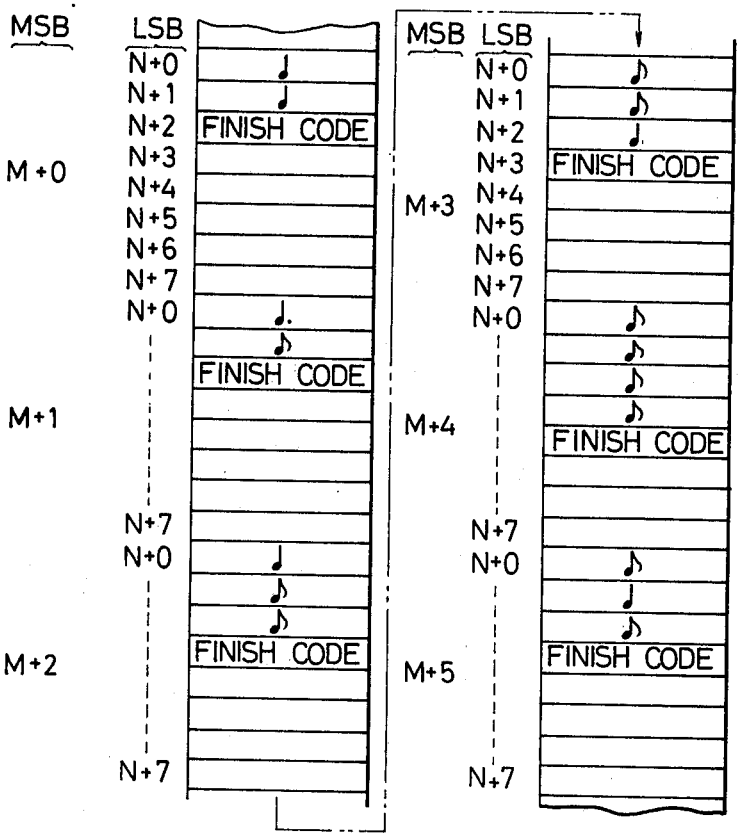
FIG. 3 is a memory map showing the data arrangement in a rhythm pattern memory shown in FIG. 1.

Aside from the above, the rhythm pattern memory 13 is comprised of a plurality of rhythm pattern memory areas as shown in FIG. 3. Each of these rhythm pattern memory areas has a plurality of addresses. This rhythm pattern memory area is specified by the numerical data latched in the latching circuit 10. Each of said addresses, in turn, is specified by the count value delivered from the concerned address counter 17. In such arrangement as described just above, it should be understood that the specifying of a given address is achieved by inputting a number of several figures. The numerical data represents the upper bits MSB of this given number, and the count value represents the lower bits LSB of this given number. The combination of these upper bits and lower bits constitutes an address signal for reading out the rhythm pattern memory. And, in the addresses of respective rhythm pattern storage areas are stored, with predetermined codes, a plurality of duration data which constitute a predetermined rhythm pattern in successive order starting from the top-leading address. Also, especially, in the final address of each of the rhythm pattern data, is stored a predetermined finish code. Also, the address counter 17 is constructed so as to be released of its reset state by a ΔCOMST "1" signal delivered thereto via an OR circuit 18, and to advance its count one after another at every arrival of a signal OK "1" which will be described later.

As such, when a given numerical data is latched in the latching circuit 10 in response to a carryout output of the corner 8 as stated above, and also when the address counter 17 is reset to "0" in response to a ΔCOMST signal, there is read out, from the rhythm pattern memory 13, only one duration data which has been stored in the top-leading address in a particular rhythm pattern storage area specified by the numerical data latched in the latching circuit 10 and forming the upper bits MSB. And, the duration data thus read out from the rhythm pattern memory 13 is supplied, in parallel, to a rhythm pattern finish detecting circuit 19 and to the composition data memory 16.

Next, description will be made of the judgement processing operation done in the judging circuit 14. The basic operation of the judging circuit 14 consists, firstly, of comparing the pitch data read out from the pitch data memory 12 with the preset musical conditions to judge whether or not the pitch data complies with the preset conditions which are stored in a music condition data memory 20. Also, in this instant embodiment, a plurality of different musical conditions are preliminarily stored in the conditional data memory 20, and at the time of condition judgement processing, these stored musical conditions are combined selectively in accordance with the grade (the acquired technical level of the pupil) to provide a ground for the judgement. And, the selection or combination of the various musical conditions is accomplished by a manual operation of a grade selection switch 21.

Musical conditions may comprise, for example, the following items.

(1) Initial or down-beat note is one of "do", "mi", "so" and "do".
(2) "si" is followed only by "do".
(3) "fa" is followed only by "mi".
(4) Ascension by augmented fourth interval is prohibited.
(5) Progression by augmented fifth interval is prohibited.

In addition to the above, items which will be selectively used (one for a grade) in accordance with grades include the following.

(6) Sharp notes are not used.
(7) "mi" and "la" are not used.
(8) "do#" and "fa#" are not used.

Based on such various musical conditions, respective pitch data read out from the pitch data memory 12 are judged, and when the result of the judgement agrees with (satisfies) the respective conditions mentioned above, the judging circuit 14 outputs a "1" pulse as a coincidence signal OK. Conversely, in the event that the read-out pitch data fails to comply with (satisfy) the abovesaid various musical conditions, the judging circuit 14 outputs a "1" pulse as a re-readout signal NEXT. Also, in this instant embodiment, a special arrangement is provided so that the precedingly selected data which has been stored in the latching circuit is used as part of the judgement grounds.

When an OK signal "1" pulse is outputted from the judging circuit 14, this pulse signal is supplied to a write-in terminal WT of the composition data memory 16 via an AND circuit 45 and an OR circuit 22. Concurrently, the OK signal "1" is supplied to a count input CK of an address counter 27 via an OR circuit 38. As a result, the resulting pitch data thus read out is stored in the composition data memory 16. At the same time, the OK signal "1" pulse is supplied to a load terminal of the latching circuit 15, and the pitch data is latched in the latching circuit 15. This signal OK, furthermore, causes the advancement of one count of the address counter 17 which determines the abovesaid lower bits LSB of the rhythm pattern memory 13, and also sets the RS flip-flop 3 via the OR circuits 23 and 5, and releases the counter 7 of its reset state. As a result, a carryout output CO is again generated from the counter 7 with the lapse of a predetermined length of time. In response thereto, a fresh numerical data which is generated from the random signal generator 11 is latched in the latching circuit 9. In response to this freshly latched numerical data, a next pitch data is read out from the pitch data memory 16. In a manner similar to that described above, this next pitch data is judged of its agreement with the musical conditions by the judging circuit 14.

Conversely, in case the pitch data read out from the pitch data memory 12 is found to be failing to satisfy the predetermined musical conditions as a result of the judgement done at the judging circuit 14, there is outputted a "1" pulse as a re-readout command signal NEXT. This signal NEXT sets the RS flip-flop 3 via an AND circuit 46, and the OR circuits 23 and 5, and releases the counter 7 of its reset state. As a result, in a manner similar to that described above, a fresh numerical data is latched in the latching circuit 9 by a carryout output CO of the counter 7. By virtue of this latched numerical data, a fresh pitch data is read out from the pitch data memory 12. In a manner similar to that stated above, another judging operation is performed.

On the other hand, each time a latching signal OK is outputted from the judging circuit 14, the count of the address counter 17 for specifying the lower bits LSB of the rhythm pattern memory 13 is advanced one after another. Here, as stated above, it should be noted that, in the respective rhythm pattern storage areas of the rhythm pattern memory 13, there are stored duration data one for each address in successive order from the top-leading address. Accordingly, each time when the pitch data read out from the pitch data memory 12 is judged, as a result of judgement processing in the judging circuit 14, as being in agreement with the predetermined musical conditions, the lower bits LSB of the rhythm pattern memory 13 will become advanced one after another. As a result, duration data which have been stored in the respective addresses of the particular rhythm pattern area specified by the upper bits MSB will become read out in successive failure. Then, those duration data read out from the respective addresses in the rhythm pattern memory 13 are written in the composition data memory 16 together with the those pitch data that have been read out from the pitch data memory 12 and judged to be in agreement with the musical conditions. Thus the combined pairs of a pitch data and a duration data constitute a composition data.

On the other hand, as shown in FIG. 3, in the rhythm pattern area which is specified by respective upper bits MSB, there is stored a finish code next to the final duration data. And, as stated above, when duration data of the respective rhythm pattern areas are read out from the rhythm pattern memory 13, and also when, finally, the end code is read out, a rhythm pattern finish detection signal "1" pulse is outputted from the rhythm pattern finish detecting circuit 19. And, by virtue of this detection signal, the RS flip-flop 4 is again set via the OR circuit 6, whereas the counter 8 is released of its reset state. Accordingly, the counter 8 begins counting, and when a predetermined count is attained, its outputs a carryout output CO.

As a result, a fresh numerical data is latched as upper bits MSB in the latching circuit 10 in response to said carryout output CO. In correspondence with this numerical data, a fresh rhythm pattern area in the rhythm pattern memory 13 is specified. Then, in a manner similar to that stated above, at each write-in, in the composition data memory 16, of the pitch data read out from the pitch data memory 12, an advancement of address takes place one after another in the particular rhythm pattern area specified in the rhythm pattern memory 13. Thus, duration data constituting respective rhythm patterns are read out one after another in successive fashion, and these duration data, along with the pitch data read out from the pitch data memory 12, are written in the composition data memory 16.

On the other hand, the detection signal "1" pulse which is outputted from the rhythm pattern finish detecting circuit 19 is supplied, as a count input, to a measure counter 47. The measure counter 47 is so constructed that it is reset by a ΔCOMST, and that at each arrival of a detection signal outputted from the rhythm pattern finish detecting circuit 19, this counter 47 will advance its count by one at a time. And, the measure counter 47 is further so constructed that it outputs a carryout output CO when pitch data for a length of 2 to 4 measures have been written in the composition data memory 16.

Accordingly, when the count of the measure counter 47 reaches a value corresponding to the predetermined number of measures during the operations of reading out pitch data from the pitch data memory; of judgement; of writing in the composition data memory; and furthermore of reading out respective duration data from the rhythm pattern memory 13, the finish data generating circuit 24 is driven by a carryout output CO of the measure counter 47, so that a predetermined finish data (for example, ALL "1") is outputted. Concurrently, the carryout output of the measure counter 47 is supplied also to the write-in terminal WT of the composition data memory 16 via the OR circuit 22. Accordingly, the finish data generated from the finish data generating circuit 24 will become stored in the final address in the composition data memory.

Figure 4:
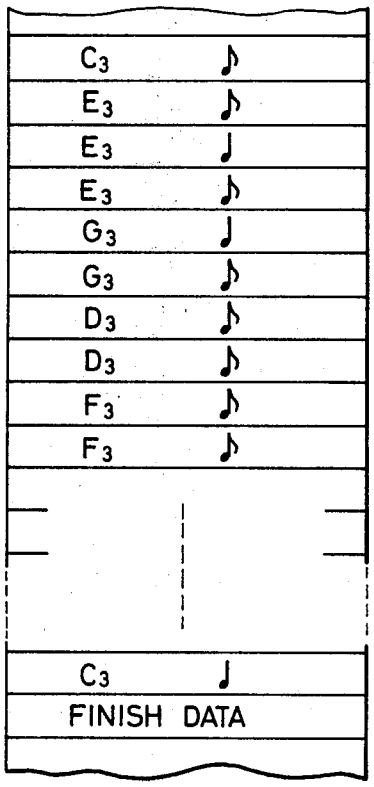
FIG. 4 is a memory map showing the data arrangement in a composition data memory shown in FIG. 1.

FIG. 4 is a memory nap showing the state of the respective pitch data and duration data which are stored in the composition data memory. As shown, a pitch data and a duration data, forming a pair, will be stored in succession in each address of the composition data memory 16, and a predetermined finish data will be written in the final address.

As stated above, when the composition start switch $SW_1$ is turned on, respective stored pitch data are extracted one at a time and one after another from the pitch data memory 12, and via the judging circuit 14, the extracted pitch data is judged of its appropriateness to satisfy the musical conditions. And, only when an agreement of this pitch data with the predetermined musical conditions is established, this extracted pitch data is transmitted to and written in the composition data memory 16. Also, concurrently therewith, from the rhythm pattern memory 13, respective duration data which constitute a certain rhythm pattern are successively written in the composition data memory 16. And, when pitch-data/duration-data pairs of such length as two to four measures are written in the composition data memory 16, the read-out of the pitch data and the duration data terminates automatically, and in succession thereto, a finish data is generated and it is written in the composition data memory 16.

Next, description will be made of the play (performance) mode operation. In order to carry out a play mode operation, a performance start switch $SW_2$ is turned on first. When the switch $SW_2$ is turned on, a "1" pulse of a very narrow width (hereinafter to be referred to as ΔPLYST) is outputted from a differentiating circuit 49 in response to the rise of "1" pulse resulting from the actuation of the switch $SW_2$. At the same time, in response to the rise of the "1" pulse, the Q output (hereinafter to be referred to as PLAY) of an RS flip-flop 25 is set to "1". Also, when the Q output of the RS flip-flop 25 is set to "1", this "1" level is supplied to the input side of an AND circuit 26 after being delayed by one clock cycle via a D flip-flop 50. Whereby, the logic condition of the AND circuit 26 is established as the later-described music piece end signal FINISH becomes "1", so that the RS flip-flop 25 will become reset.

When ΔPLYST and PLAY are outputted in this way, an address counter 27 is reset by a ΔPLYST which is supplied thereto via an OR circuit 29. Concurrently therewith, a duration counter 28 is reset by a ΔPLYST which is supplied thereto via an OR circuit 30.

Here, it should be understood that, as stated above, a pitch data and a duration data, in a pair, are stored in respective addresses of the composition data memory 16 as shown in FIG. 4. And, a finish data is stored in the final address thereof.

Accordingly, when the address counter 27 is reset as stated above, a pitch data and a duration data which have been stored in the top-leading address are read out in parallel from the composition data memory 16. And, the pitch data is supplied to a music tone forming circuit 51 so that a music tone formation processing is carried out. Whereby, the formed music tone signal having a pitch determined by the pitch data is amplified by an amplifier 52 and then is sounded from a loudspeaker 53.

Also, the pitch data read out from the composition data memory 16 is supplied, in parallel, to a CRT controlling circuit 32 and to a printer controlling circuit 33. The CRT controlling circuit 32 carries out a predetermined image processing based on the pitch data which is read out from the composition data memory 16, and causes a CRT 34 to display music notes corresponding to said pitch data by utilizing, for example, music score lines. Also, the printer controlling circuit 33 processes said pitch data into a predetermined character print format, and causes a printer 35 to print out this print format on a music sheet.

On the other hand, the duration data which is read out from the composition data memory 16 is supplied to the data input side of a duration comparing circuit 36. Here, each duration data is a data which represents the duration of each note in terms of the number of cycles of a tempo clock pulse. For example, a quarter note duration is expressed by a data value "48", which means that a quarter note has a time length of forty-eight clock pulse cycles. Likewise, an eighth note duration is expressed by "24" and a half note by "96".

The frequency of the tempo clock pulse is variable within the range from 40 Hz to 240 Hz to cover tempo rates M.M. $=50\sim300$. A count value of the duration counter 28 is supplied to the reference input side of the duration comparing circuit 36. The duration counter 28 is so constructed as to count tempo clock pulses TCL outputted from a tempo clock pulse generator 54.

Accordingly, when the duration comparing circuit 36 judges the agreement of the duration data which is then read out with the count value of the duration counter 28, a coincidence signal EQ "1" is outputted. At such time, the input condition of an AND circuit 37 is established as PLAY "1" and EQ "1". The address counter 27 is caused to advance its count via an OR circuit 38 by an output of this AND circuit 37.

When the count value of the address counter 27 advances by one in this way, a pair of pitch data and duration data which have been stored in the next address is read out from the composition data memory 16 as shown in FIG. 4, and thus successive pairs supplied to the music tone forming circuit 51, the CRT controlling circuit 32 and the printer controlling circuit 33 in a manner as stated above.

Accordingly, when the performance start switch $SW_2$ is turned on, a melody corresponding to the composed music score which is stored in the composition data memory 16 is sounded from the loudspeaker 53. Concurrently, this music score is displayed on the screen of the CRT 34 in the form of a music score display, and furthermore the music score is printed out on a music sheet by the printer 35.

When a finish data which has been stored in the final address is read out from the composition data memory 16 as shown in FIG. 4 during the while the above operations are repeated, the finish detecting circuit 39 is driven, and a finish detection signal FINISH is outputted therefrom. This signal FINISH is supplied to said AND circuit 26. As a result, the RS flip-flop 25 is reset, and the signal PLAY becomes "0", and the count advancement of the address counter 27 is inhibited. That is, the read-out of respective duration data and pitch data from the composition data memory 16 terminates.

Thus, the apparatus for automatically composing a music piece shown and described with respect to this instant embodiment is arranged so that plural kinds of pitch data re stored in the pitch data memory 12, and on the other hand, as for the address signal for addressing this pitch data memory, there is used a random numerical data which is read out from the random signal generator 11. Therefore, the pitch data which is read out from the pitch data memory 12 becomes a very non-uniformal data assorted with no artificial character or individuality. Furthermore, these pitch data which are read out non-uniformally are arranged in musical order in line with the predetermined music conditions. Accordingly, the music piece which is stored in the composition data memory 16 will become a melody having a very modern style, not inclined to a certain fixed individuality as in the conventional cases wherein a theme music piece has been composed by a teacher. Also, when a composing mode is repeated over and over again, there can be obtained a different melody each time of such repetitions. Thus, the room of selection at the time of obtaining a theme music piece is not narrowed unlike in the conventional cases wherein a part of the existing music composition is utilized. Thus, in case the apparatus of the present invention is used, there can be carried out a very adequate and effective sound-dictation training and performance exercise in such occasion as musical education.

Furthermore, in this instant embodiment, the conditions for judgement done by the judging circuit 14 can employ selective combinations of various musical conditions so as to suit the musical grade of pupils. Thus, in such place as musical education, it is possible to arbitrarily select the musical level of the music piece which is composed through a wide range from an easy level to a high level. Also, if the musical conditions which are stored in the condition data memory 20 are so arranged as to present a specific style, it is also possible to freely obtain a melody which is a music piece of a favorite trend and yet is not presumable beforehand.

Still further, in this instant embodiment, the means for obtaining a duration data to be combined with each pitch data is arranged so that preliminarily plural note durations are arranged in a predetermined order to form a rhythm pattern segment, and data of such segments (plural and different) are stored in a rhythm pattern memory so as to be read out randomly. Therefore, by combining plural sets of such rhythm pattern segments, it is possible to certainly obtain a rhythm pattern of precisely two to four measures. That is, the length of each rhythm pattern segment data is set preliminarily at a same constant length of time, e.g. two quarters (crotchets). Therefore, by reading out a plurality of such sets, it is possible to obtain such rhythm pattern as will unfailingly finish at the end of a measure.

Yet further, in this instant embodiment, arrangement is provided that each duration data constituting each of said rhythm pattern data is expressed by a data which represents the duration of each note in terms of the number of cycles of a predetermined tempo clock pulse TCL; that along therewith, each rhythm pattern storage area is set so as to correspond to respective upper bits MSB of the rhythm pattern memory; and that, furthermore, the respective addresses of the rhythm pattern storage area are designated one at a time by the lower bits LSB of the rhythm pattern memory. Thus, the memory areas for storing rhythm pattern data can be very effectively utilizing. Also, it becomes possible to have a pitch data and a duration data which constitutes a rhythm pattern are stored concurrently, as a parallel data, in a single address of the composition data memory 16. Thus, it is possible to effectively utilize the memory areas of the composition data memory 16. Also, each pitch data and each duration data are stored, in a pair, in each address of the composition data memory 16. Therefore, it becomes possible to arrange the automatic performance processing circuit in such manner that the output lines of the composition data memory are devided into their upper bits and lower bits to thereby be able to easily separate the duration data from the pitch data. Thus, it becomes possible to simplify the arrangement of the automatic performance circuit.

In this instant embodiment, description has been made of the musical conditions in the judging circuit 14 as comprising (1) to (8) items. Such musical conditions may include various other items, which may be enumerated as follows.

(9) Use of a sharp note as the final sound is prohibited.

(10) Number of sharp notes used in a single melody is two at the most.

(11) Final note must not be identical with the one-preceding note.

As will be understood, various kinds of musical conditions may be enumerated. By their appropriate combination, it becomes possible to freely set or select the musical style of the composition.

Also, especially in this instant embodiment, when agreement with the predetermined musical conditions is to be judged by the judging circuit, arrangement is provided so that the pitch data stored in the latching circuit 15 and read out just prior to the present pitch data is utilized as part of the latter's judgement material. Accordingly, in case such factor as the difference of pitch level between the preceding note and a next note is judged, such judgement can be made with a great simplicity.

As will be appreciated from the above-described embodiment, the automatic composing apparatus according to the present invention is arranged so that plural kinds of pitch data are preliminarily stored in a pitch data memory, that the pitch data which have thus been stored in the pitch data memory are read out randomly, that the readout pitch data is compared with the predetermined musical conditions, that in case the readout pitch data is found to be in agreement with the preset musical conditions, said pitch data is selected as one of the constituent notes of the composition which is to be formed, and that in case of disagreement, pitch data are randomly read out again repeatedly from the pitch data memory, whereby those pitch data which are read out from the pitch data memory are arranged in as musical fashion as possible to thereby compose a music piece. Thus, by making use of this apparatus, it is possible even for a person having no musical knowledge to easily obtain a series of pitch data which are arranged in musical fashion. Accordingly, by applying a rhythm pattern data to the obtained pitch data as mentioned in this instant embodiment, it is possible to obtain a music piece of a given length by a very simple prodecure. Also, only if the user is able to arrange pitch data in serial fashion while complying with the set musical conditions, it will be relatively easy for him to compose a music piece by adding a rhythm pattern data thereto. Thus, the user need not try to automatically form as far as rhythm pattern as shown in this embodiment, but instead it is possible for him to easily compose a music piece manually. More particularly, the user can just commands the apparatus to print out pitch data which have been arranged in serial fashion and metting the preset musical conditions, and by adding a rhythm pattern thereto, there can be composed some kind of music piece. As such, also in case sound-dictation training or performance exercise is done in a place of musical education, it becomes unnecessary for the teacher to compose by himself a theme music which is to be used for such purposes. Further, the room of selection of theme music can be expanded widely. Also, the problem of the trend of theme music to incline toward a certain fixed style can be eliminated. Thus, it is possible to markedly enhance the result of training which is given in this type of musical education.

Figure 5A:
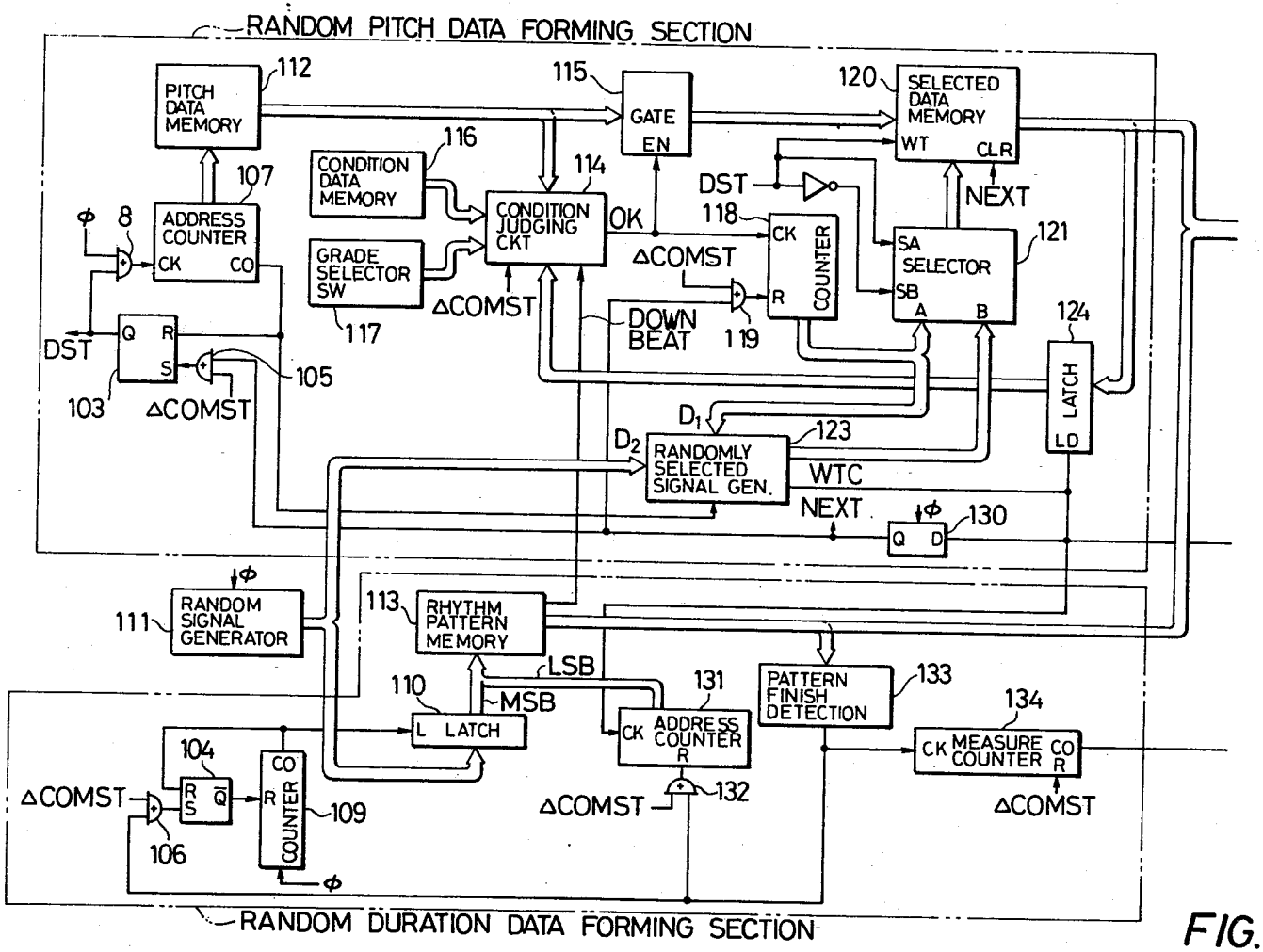
FIGS. 5A and 5B are, in combination, a block diagram showing another embodiment of the present invention.
Figure 5B:
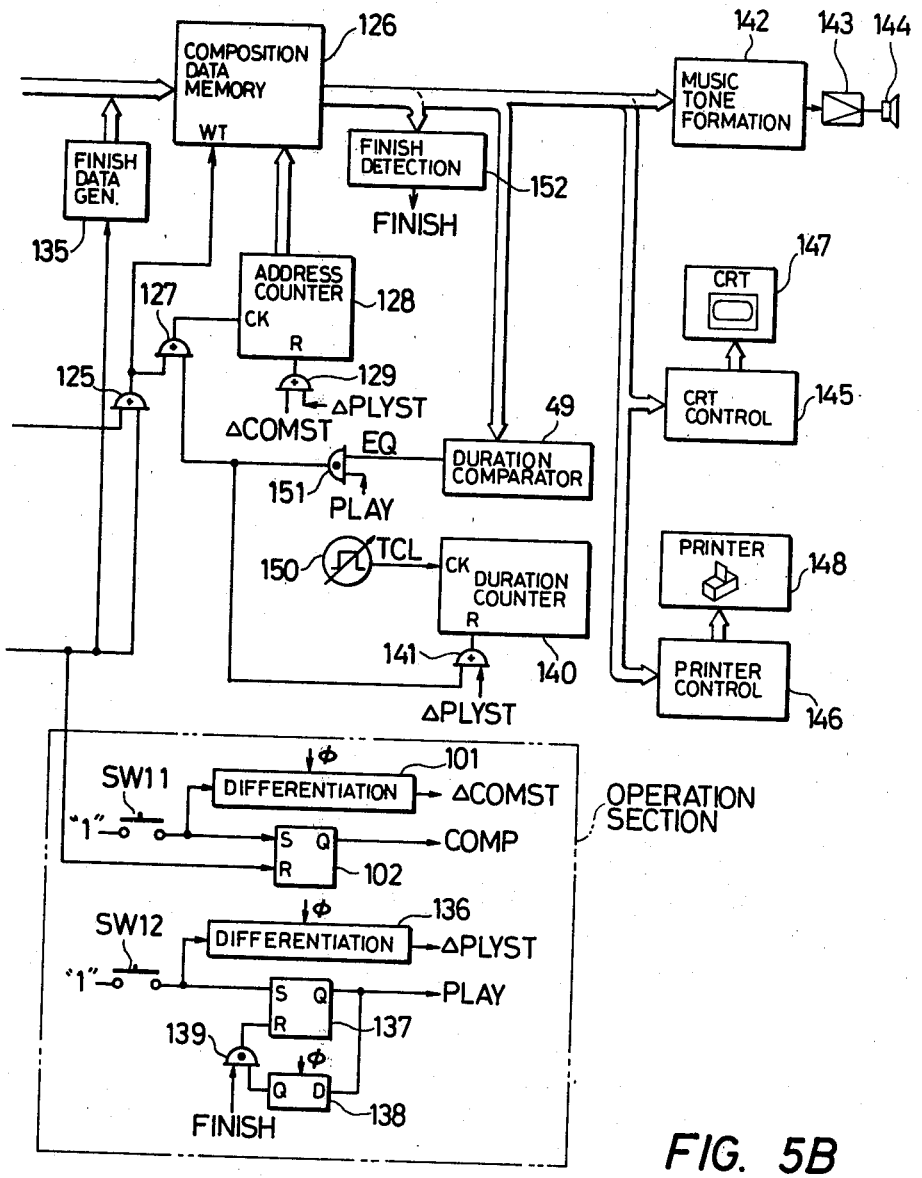

FIGS. 5A and 5B are in combination a block diagram showing the overall arrangement of another or second embodiment of the automatic composing apparatus according to the present invention.

This second embodiment is similar to that of the preceding embodiment, with the exception that, in order to deliver each pitch data, those pitch data which are in agreement with predetermined musical conditions are first extracted and from among them one pitch data is selected randomly. As in the preceding embodiment, this second embodiment has two operating modes consisting of composing mode and performing mode.

In FIGS. 5A and 5B, the performing mode is identical with that of FIGS. 1A and 1B, so that only the composing mode will be described herebelow. The composition start switch $SW_{11}$, the differentiating circuit 101 and the RS flip-flop 102 may be identical with the switch $SW_1$, the circuit 1 and the flip-flop 2, respectively, shown in FIG. 1B. Upon the switch $SW_{11}$ being turned on, the differentiating circuit 101 and the RS flip-flop 102 will output ΔCOMST and COMP, respectively. When ΔCOMST and COMP are outputted, the RS flip-flops 103 and 104 are set, respectively, by a ΔCOMST which is supplied thereto via OR circuits 105 and 106, respectively, so that the Q output of the RS flip-flop 103 (hereinafter this Q output will be referred to as DST) becomes "1", and the Q output of the RS flip-flop 104 becomes "0".

As a result, an address counter 107 begins to count system clock pulses $\phi$ which are supplied thereto via an AND circuit 108, while a counter 109 is released of its reset state, and begins to count clock pulses $\phi$.

After that, the count value of the address counter 107 continues to advance one after another in timed sequence with the clock pulse $\phi$. On the other hand, when this count value arrives at a predetermined maximum value, a numerical data which is outputted from a random signal generator 111 is latched in a latching circuit 110 which corresponds to the latching circuit 10 of FIG. 1A, by a carryout output CO delivered from the counter 109.

The random signal generator 111 may be identical with the random signal generator 11 of FIG. 1A. This random signal generator 111 outputs successively, at a very narrow constant interval, random numerical data. Therefore, as stated above, by causing the counters 107 and 109 to begin counting, and by driving the latching circuit 110 by a carryout outputs CO of these counters upon reaching a certain count value, such random numerical data having no regularity at all are latched in the latching circuit 110.

And, the count output of the address counter 107 is utilized as the address signal for the pitch data memory 112. On the other hand, the numerical data which is latched in the latching circuit 110 is utilized as the address signal MBS for the rhythm pattern memory 113.

In the respective addresses of the pitch data memory 112, there are stored in successive order a series of pitch data with predetermined codes as shown in FIG. 2, in a manner similar for the pitch data memory 12 shown in FIG. 1. Accordingly, as stated above, when the count value of the address counter 107 advances in timed sequence with the system clock pulse $\phi$, there are read out successively, in timed sequence with the system clock pulse $\phi$, from the pitch data memory 112 a series of pitch data which have been stored in the respective addresses. And, the readout pitch data is supplied, in parallel, to a judging circuit 114 and a gating circuit 115.

The judging circuit 114 is intended to make judgement whether the pitch data read out from the pitch data memory 112 satisfies the predetermined musical conditions. Those various musical conditions which are used for this judging operation have been stored in a musical condition data memory 116. A grade selecting switch 117, like the grade selecting switch 21 of FIG. 1A, is used to selectively combine various musical conditions which are stored in the musical condition data memory 116. The judging circuit 114 carries out its judgement processing by appropriately combining those musical conditions which are selected by the grade selecting switch 117 from among the various musical conditions stored in the musical condition data memory 116.

The musical conditions which are employed in this second embodiment may be identical with those stored in the condition data memory 20 of FIG. 1A.

When the pitch data which are read out from the pitch data memory 112 are found as satisfying the predetermined musical conditions as a result of judgement done by the judging circuit 114, the judging circuit 114 outputs a coincidence signal OK of "1" pulse.

Accordingly, in case the pitch data are judged by the judging circuit 114 as being in agreement with the preset musical conditions, the coincidence signal OK is supplied to an enable terminal EN of the gating circuit 115 and to a clock pulse input terminal CK of a counter 118. The counter 118 is already reset at the time of the start of the composing mode operation by a ΔCOMST which is supplied thereto via an OR circuit 119. Also, at said time, the signal DST is set to "1". Accordingly, a selected data memory 120 is set to a write-in mode by the DST "1". Concurrently therewith, a selector 121 is selected of its A input terminal.

As a result, those data which have been judged first as satisfying the musical conditions after the starting the read-out of a series of data from the pitch data memory 112 are stored in the top-leading address in the selection data memory 120.

Then, as a further series of pitch data is read out successively from the pitch data memory 112, an initial note of a desired composition piece which is comprised of a pitch data satisfying the predetermined musical conditions will be written successively in the respective addresses in the selected data memory 120.

Next, when the count output of the address counter 107 reaches a predetermined maximum value, a "1" pulse is outputted from the carryout terminal CO. In response to this "1" pulse, the DST is reset to "0". Concurrently, this carryout output CO "1" pulse is supplied to a randomly selected signal generating circuit 123.

When the DST is reset to "0" in this way, the selected data memory 120 is set to the readout mode, and at the same time, the selector 121 is selected of its B input terminal.

The randomly selected signal generating circuit 123 is constructed with: a data discriminating circuit which, at each arrival of a carryout output "1" pulse from the address counter 107, compares the numerical data $D_1$ outputted from the counter 118 with a numerical data $D_2$ which is outputted from the random signal generator 111 to effect discrimination of the presence of the relation of $D_1 \geqq D_2$; a latching circuit which, in response to the discrimination output of said data discriminating circuit, latches the numerical data $D_2$ which is outputted from the random signal generator 111; and a pulse generating circuit which outputs a signal WTC "1" each time the numerical data $D_2$ is latched. The output of said latching circuit is supplied, as the address signal of the selected data memory 120, to the B input terminal of a selector 121.

As a result, when, at the timing at which the address counter 107 has completed its count, the value of the numerical data $D_2$ outputted from the random signal generator 111 satisfies the relation $D_1 \geqq D_2$, the numerical data outputted from the random signal generator 111 is supplied, as an address signal, to the selected data memory 120. As a result, there is read out, from the selected data memory 120, only one pitch data which has been stored in said address.

On the other hand, the WTC "1" pulse which is outputted from the randomly selected signal generator 123 is supplied to a load terminal LD of a latching circuit 124, and also is supplied, via an OR circuit 125, to a write-in terminal WT of a composition data memory 126 and, via an OR circuit 127, to a clock pulse input terminal CK of an address counter 128. Here, it should be noted that the address counter 128 has been reset at the start point of the composing mode by a signal ΔCOMST which is supplied thereto via an OR circuit 129.

Accordingly, as stated above, when one of the pitch data is read out from the selected data memory 120 in correspondence to the numerical data $D_2$, this readout pitch data is latched by a latching circuit 124 and also is written in the top-leading address in the composition data memory 126.

Furthermore, after being delayed by an interval of one cycle of clock pulse $\phi$ via a D flip-flop 130, the signal WTC is supplied, as a re-readout start signal NEXT, to a clear input CLR of the selected data memory 120 directly and to a set input S of the RS flip-flop 103 via the OR circuit 105.

As a result, when a pitch data is read out from the selection data memory 120, this selection data memory 120 is cleared immediately thereafter. At the same time, the signal DST is also rendered to "0", so that the advancement of count of the address counter 107 is resumed. Concurrently, the selector 121 is switched over and set to its A input terminal.

Then, there is carried out the read-out of a series of pitch data for the second time from the pitch data memory 112. In a manner similar to that mentioned above, those pitch data which are read out successively are subjected to judgement, in the musical condition judging circuit 114, of their agreement with the predetermined musical conditions. In the judging operations which are conducted at the second time and thereafter, a coincidence judgement operation is carried out relative to the predetermined musical conditions based on the precedingly selected pitch data which are latched in the latching circuit 124.

More specifically, among the musical conditions which are stored in the condition data memory 116, items (2) to (6) are carried out.

With respect to item (1) among the said musical conditions, a musical condition agreement judging operation is carried out based on ΔCOMST and on the downbeat signal outputted from the rhythm pattern memory 113.

When, in this way, the reading-out of a series pitch data for the second time from the pitch data memory 112 completes, the selected data memory 120 is set to the readout mode in a manner similar to that stated above. Concurrently, the selector 121 is selected to its B input. And, in a manner similar to that stated above, one of the pitch data is read out from the selected data memory 120 based on the numerical data $D_2$ which is outputted from the random signal generator 111, and it is stored in the second address in the composition data memory 126. Concurrently therewith, said pitch data is latched also in the latching circuit 124.

By repeating the above-stated operation, there are stored, in successive order in the respective addresses in the composition data memory 126, those pitch data which have been stored in the selected data memory 120 based on the fact of agreement with the musical conditions and which have been read out randomly based on the numerical data $D_2$ outputted from the random signal generator 111.

On the other hand, each time a signal WTC is outputted from the randomly selected signal generating circuit 123, the count value of an address counter 131 for specifying the lower bits LSB of the rhythm pattern memory 113 is advanced one at a time.

Here, the rhythm pattern memory 113 is provided, in the same manner as for the rhythm pattern memory 13 of FIG. 1A, with a plurality of rhythm pattern storage areas (which, in this embodiment, are six in number) which are specified by the numerical data MSB latched in the latching circuit 110, respectively. These storage areas each is comprised of a plurality of addresses which, in turn, are specified by the numerical values LSB of an address counter 131, respectively. Also, the address counter 131 is so constructed that it is momentarily reset by a ΔCOMST which is supplied thereto via an OR circuit 132, and that its count starts from zero and advances at each arrival of the signal WTC.

Accordingly, as stated above, each time one of the pitch data is read out from the selected data memory 120, the count value LSB of the rhythm pattern memory 113 advances one after another, and thus the duration data which are stored in the respective addresses of the rhythm pattern area specified by the upper bits MSB are read out successively.

Then, those duration data which are read out from the respective rhythm pattern areas of the rhythm pattern memory 113 each is written in the composition data memory 126 in a pair with the pitch data which is read out from the selected data memory 120.

When duration data in the respective rhythm pattern areas are read out and finally a finish code is read out from the rhythm pattern memory 113, a rhythm pattern finish detection signal "1" pulse is outputted from a rhythm pattern finish detecting circuit 133. And, by this detection signal, the RS flip-flop 104 is again set via the OR circuit 106, and the counter 109 is released of its reset state. Accordingly, the counter 109 begins counting, and when the count reaches a predetermined value, it outputs a carryout output CO.

As a result, a fresh numerical data is latched, as upper bits MSB, in the latching circuit 110 in response to the carryout output CO. In response to this new numerical data, a fresh rhythm pattern area in the rhythm pattern memory 113 is specified.

Then, in a manner similar to that described above, each time that the pitch data read out from the selected data memory 120 is written in the composition data memory 126, there is conducted an address advancement, one at a time, in the specified rhythm pattern area of the rhythm pattern memory 113. And, concurrently therewith, the duration data which constitute respective rhythm patterns are read out one after another, and they are written, together with the pitch data read out from the selected data memory 120, in the composition data memory 126.

On the other hand, the detection signal "1" pulse which is outputted from the rhythm pattern finish detecting circuit 133 is supplied as a count input to a measure counter 134. The measure counter 134 is so constructed that it is reset by ΔCOMST and that at each arrival of a detection signal outputted from the rhythm pattern finish detecting circuit 133, its count advances one at a time. This measure counter 134 is also arranged so that it generates a carryout output CO upon pitch data of the order of two to four measures being written in the composition data memory 126.

Accordingly, when the count of the measure counter 134 reaches a value corresponding to a predetermined number of measures during a series of operations, i.e. read-out of pitch data from the pitch data memory, judgement, write-in of data in the composition data memory, and further the read-out of respective duration data from the rhythm pattern memory 113, a finish data generating circuit 135 is driven by the carryout output CO of the measure counter 134, so that a predetermined finish data which, for example, is ALL "1" is outputted. Concurrently therewith, the carryout output of the measure counter 134 is supplied also to the write-in terminal WT of the composition data memory 126. Therefore, the finish data which is generated from the finish data generating circuit 135 is stored in the final address in the composition data memory.

In this way, such composition data as shown in FIG. 4 is stored in the composition data memory 126.

As stated above, upon turning-on of the composition start switch $SW_{11}$, stored respective pitch data are successively read out one at a time from the pitch data memory 112, and they are judged of their agreement with the musical conditions by the judging circuit 114. And, only when a coincidence with the predetermined musical conditions is established, the read-out pitch data is transmitted to the selected memory data memory 120 to be written therein, and furthermore one of these written-in data is read out randomly to be written in the composition data memory 126.

Also, at the same time therewith, respective duration data which constitute a predetermined rhythm pattern are successively written in the composition data memory 126 from the rhythm pattern memory 113 together with the successive pitch data. And, when pitch data and duration data of an amount of the order of two to four measures are written in the composition data memory 126, the read-out of pitch data and duration data automatically terminates, and in succession thereto, a finish data is generated and is written in the composition data memory 126.

The performance mode operation is altogether the same as that of the automatic composing apparatus shown in FIGS. 1A and 1B, and therefore its description is omitted. It should be noted here that the switch $SW_{12}$, differentiating circuit 136, RS flip-flop 137, D flip-flop 138, AND circuit 139, duration counter 140, OR circuit 141, music tone forming circuit 142, amplifier 143, loudspeaker 144, CRT controlling circuit 145, printer controlling circuit 146, CRT 147, printer 148, duration comparing circuit 149, tempo clock pulse generator 150, AND circuit 151 and finish detecting circuit 152 are same as those parts of FIG. 1 indicated by reference numerals and symbols $SW_2$, 49, 25, 50, 39, 28, 30, 51, 52, 53, 32, 33, 34, 35, 36, 54, 37 and 39, respectively.

As described above, in the automatic composing apparatus shown in this second embodiment, arrangement is provided so that a series of pitch data are stored in the pitch data memory 112, and while reading them out successively, they are judged of their coincidence with musical conditions, successively, and a bunch of those pitch data satisfying the musical conditions is stored in the selected data memory 120, and then from among those pitch data stored in the selected data memory 120 and agreeing with the preset musical conditions, one of them is read out to be adopted as one of the notes which constitute a music piece. Therefore, the music piece which is stored in the composition data memory 126 will become a melody of a very modern style, without inclining to a certain fixed individuality as in the conventional cases wherein a theme music piece is composed by a teacher. Also, by repeating the composing mode operation over and over again, it is possible to obtain a different melody each time of such repetition. Thus, the room of selection of a theme music is not narrowed unlike in the practices done in the past. Accordingly, by utilizing this apparatus, a very suitable and effective sound-dictation training or performance exercise can be achieved in providing musical education. Other advantages of this apparatus are the same as those described in connection with the first embodiment, and therefore their description is omitted.

Figure 6A:
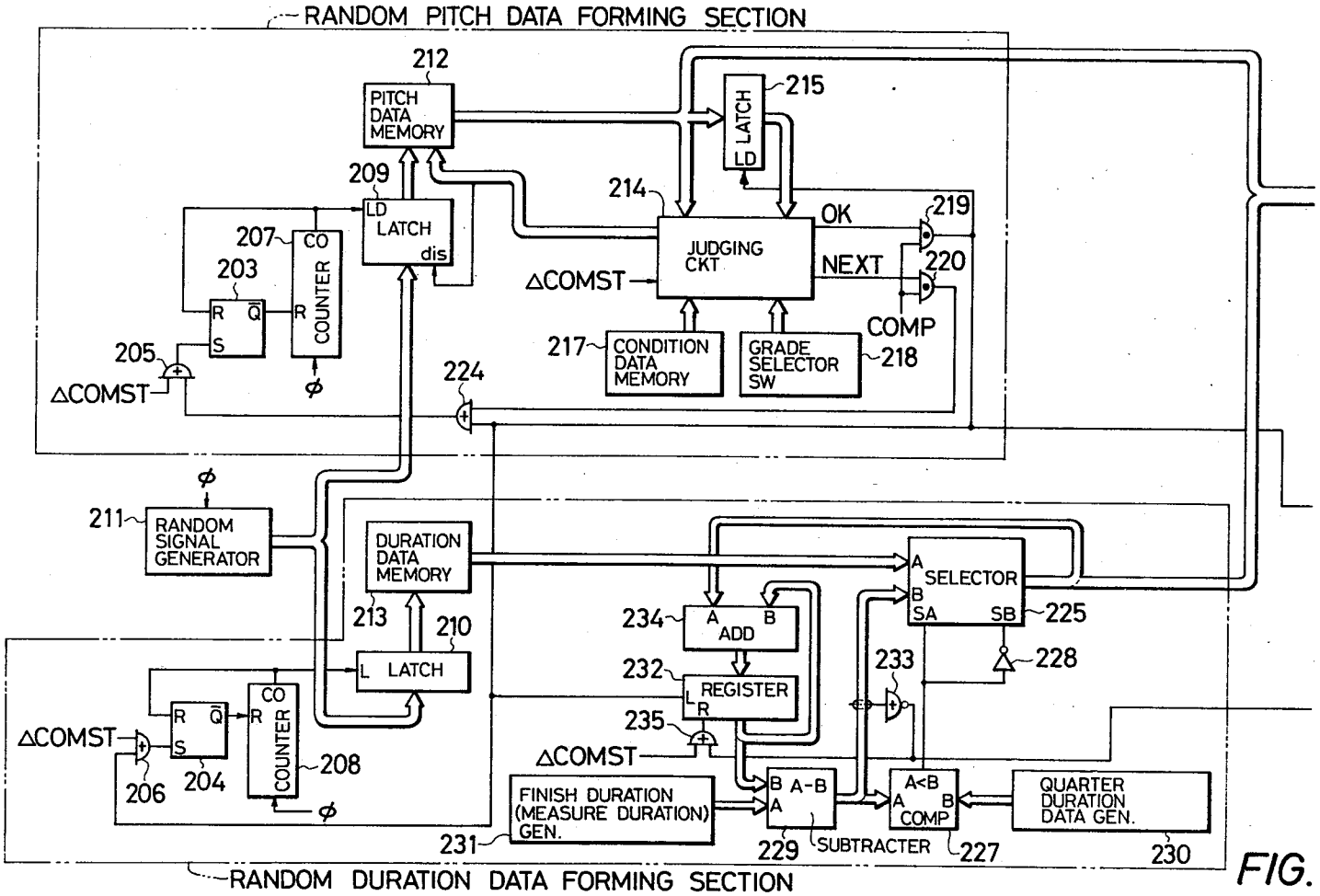
FIGS. 6A and 6B are, in combination, a block diagram showing still another embodiment of the present invention.
Figure 6B:
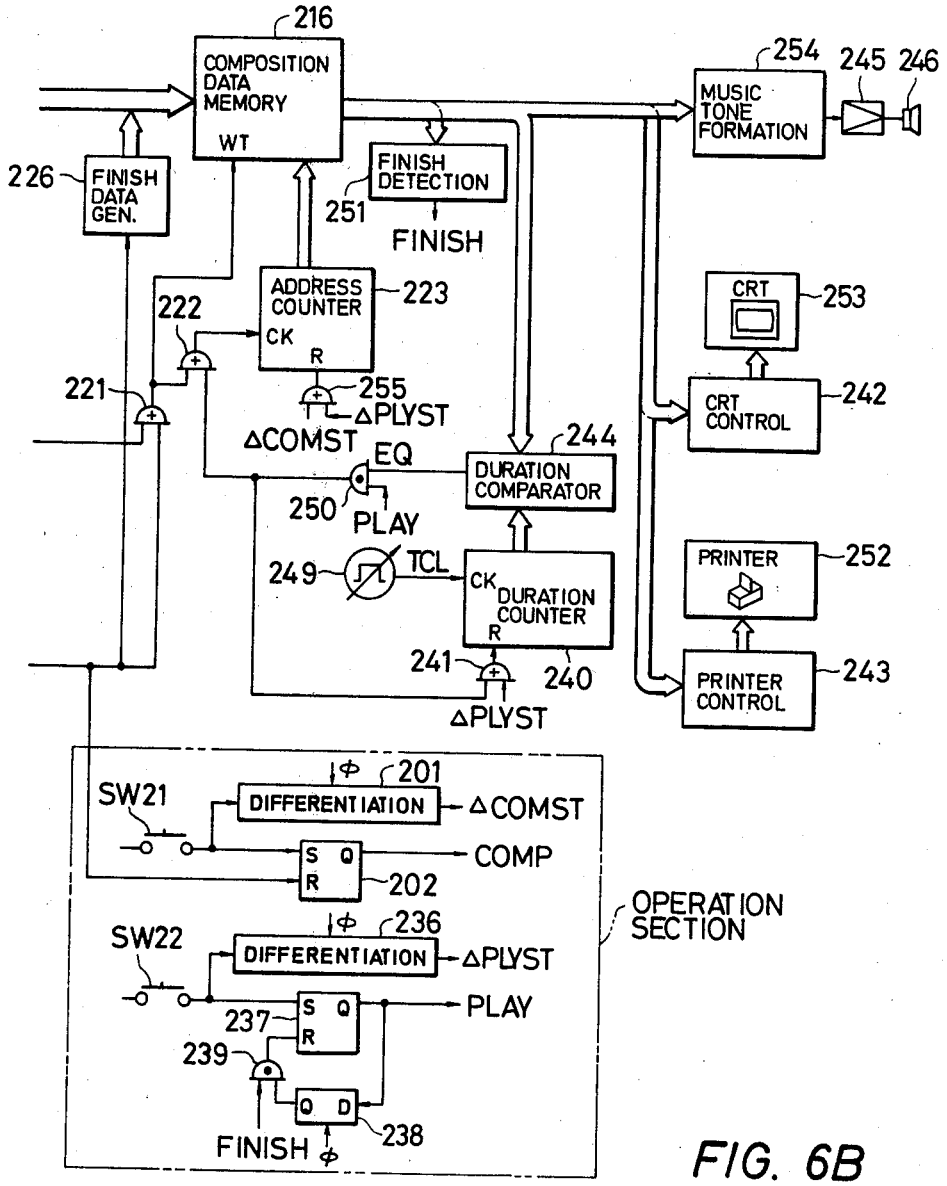

FIGS. 6A and 6B are a block diagram showing the electric arrangement of a third embodiment of the automatic composing apparatus of the present invention.

The automatic composing apparatus shown in this embodiment has two operating modes consisting of a composing mode and a performing mode as in the preceding two embodiments. In the composing mode operation, pitch data and duration data are randomly read out respectively from a pitch data memory and a duration data memory which will be described later. The pitch data which read out is judged of its agreement with predetermined musical conditions, and only the pitch data which has been judged as satisfying the musical conditions is transmitted to a composition data memory. In contrast thereto, the duration data are directly written successively in the composition data memory in parallel with the pitch data. And, when the accumulated value of the duration data which are read out successively from the duration data memory reaches a certain length of music piece, the reading-out of duration data from the duration data memory is prohibited. Instead, a duration data corresponding to a predetermined length up to the end of the preset music piece is written in the composition data memory.

As a result, at the end of the composing mode operation, pitch data and duration data, forming respective pairs, are staying successively in the respective addresses in the composition data memory, to thereby compose a desired music piece.

In contrast thereto, the performance mode operation is exactly the same as that of the embodiment shown in FIGS. 1A and 1B, so that its explanation is omitted, and description will be made hereunder only of the composing mode operation.

In order to set to the composing mode operation, the first step to do is to turn the composition start switch $SW_{21}$ on. Upon this actuation of the switch $SW_{21}$, a "1" pulse of a very narrow width (hereinafter this will be referred to as ΔCOMST) is outputted in response to the rise of said "1" pulse. Concurrently, as RS flip-flop 202 is set by the rise of "1", and its Q output (hereinafter to be referred to COMP) is set to "1".

When a ΔCOMST and a COMP are outputted in this way RS flip-flops 203 and 204 are set, respectively, by a ΔCOMST which is supplied thereto via OR circuits 205 and 206, respectively, and their Q outputs become "0". As a result, counters 207 and 208 are released of their reset state, respectively, and begin to count a system clock pulse $\phi$. When a preset count value is attained, numerical data which are outputted from a random signal generator 211 are latched in latching circuits 209 and 210 by a carryout outputs CO outputted from these counters 207 and 208, respectively.

The random signal generator 211 is constructed with, for example, a shift register which, in turn, is arranged so as to operate as a maximum length counter. From this random signal generator 211 are outputted successively random numerical data at a very small interval $\phi$. Accordingly, by causing the counters 207 and 208 to begin counting as stated above, and by driving the latching circuits 209 and 210 by the carryout outputs CO of these counters upon a certain count value being reached, there will be latched, in the latching circuits 209 and 210, random numerical data which are free of regularity of style.

The numerical data which has been latched by the latching circuit 209 is utilized as an address signal for a pitch data memory 212, while the numerical data which has been latched in the latching circuit 210 is utilized as an address signal for a duration data memory 213.

Figure 7:
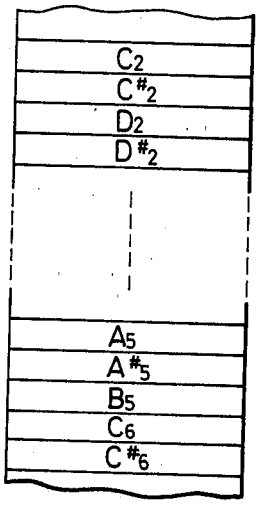
FIG. 7 is a memory map showing the arrangement of respective pitch data stored in the pitch data memory shown in FIG. 6A.

In the respective addresses of the pitch data memory 212 are stored, in successive fashion, plural kinds of pitch data by predetermined codes as shown in FIG. 7. Accordingly, when random numerical data are latched as address signals in the latching circuit 209 as stated above, there will be read out from the pitch data memory 212 only one pitch data stored in the address corresponding to said address signal. This readout pitch data is supplied, in parallel, to a judging circuit 214, a latching circuit 215 and a composition data memory 216.

The judging circuit 214 is intended to make judgement whether the pitch data read out from the pitch data memory 212 satisfies the preset musical conditions. Those various musical conditions which are employed in this judging operation are stored in a condition data memory 217. Also, a grade selecting switch 218 is used to selectively combine various kinds of musical conditions stored in the condition data memory 217. The judging circuit 214 is intended for carrying out a judgement operation by appropriately combining those musical conditions selected by a grade selecting switch 218 from among the various kinds of musical conditions stored in the condition data memory 217.

In this third embodiment, it should be understood that, as the musical conditions stored in the condition data memory 217, it is possible to utilize same conditions as those stored in the condition data memory of FIG. 1A.

In the judging circuit 214, in case the pitch data read out from the pitch data memory 212 is judged as satisfying the predetermined musical conditions, this judging circuit 214 outputs a "1" pulse as a coincidence signal OK. Conversely, when the pitch data read out from the pitch data memory 212 is judged as not satisfying the musical conditions, the judging circuit 214 outputs a "1" pulse as a re-readout command signal NEXT. At such time, a "1" pulse of a signal COMP is supplied to the other input terminals of AND circuits 219 and 220 which are inserted in the output paths of the coincidence signal OK and the re-readout command signal NEXT.

As such, when a pitch data is judged as satisfying the musical conditions by the judging circuit 214, the coincidence signal OK is supplied, via the AND circuit 219 and an OR circuit 221, to the write-in terminal WT of the composition data memory 216. Concurrently, said signal OK is supplied, via the AND circuit 219 and the OR circuit 221, to the count input terminal CK of an address counter 223. Whereby, a pitch data which is read out from the pitch data memory 212 is written in the top-leading address in the composition data memory 216.

The signal OK further is supplied to the RS flip-flop 203 via OR circuits 224 and 205. Whereby, in a manner similar to that stated above, the counter 207 is again released of its reset state, and begins counting the system clock pulses $\phi$. A fresh random numerical data is latched in the latching circuit 209 by a carryout output CO which is generated upon completion of the counting. In correspondence to successively selected ones of the freshly latched numerical data, fresh pitch data are read out successively from the pitch data memory 212.

Conversely, when, as a result of judgement done by the judging circuit 214, the pitch data is not recognized as satisfying the predetermined musical conditions, the signal NEXT is supplied to the RS flip-flop 203 via an AND circuit 220 and the OR circuits 224 and 205. In a manner similar to that stated above, the counter is released of its reset state, and begins counting the system clock pulses $\phi$. By a carryout output CO which is generated upon completion of counting by the counter, a fresh numerical data is latched in the latching circuit 209. In correspondence thereto, a fresh pitch data is read out from the pitch data memory 212.

In this way, the judging circuit 214 judges whether the fresh pitch data which is read out from the pitch data memory 212 is in agreement with the predetermined musical conditions each time a fresh pitch data is read out. In case of agreement, the pitch data is written successively in the composition data memory 216. Conversely, in case of diagreement, the transmission of the pitch data to the composition data memory 216 is prohibited, and instead, the judging circuit 214 commands the pitch data memory 212 to read out again a fresh pitch data.

Accordingly, during the course of the above-mentioned operations being repeated, those pitch data which are read out randomly from the pitch data memory 212 are appropriately selected and picked up and arranged so as to be in agreement with the musical conditions, and thus there is formed in the composition data memory 216 a series of pitch data which constitute a music piece.

Figure 8:
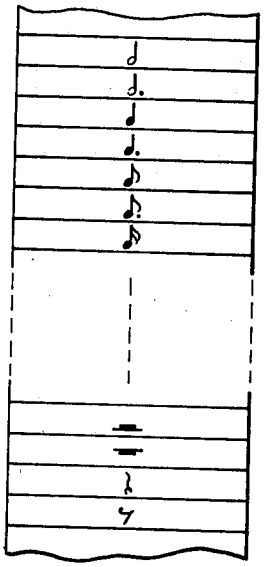
FIG. 8 is a memory map showing the arrangement of respective duration data stored in the duration data memory shown in FIG. 6A.

On the other hand, in the respective addresses of the duration data memory 213, plural kinds of duration data are stored by predetermined codes as shown in FIG. 8.

Also, a signal OK is supplied to the RS flip-flop 204 via the OR circuit 206. As a result, the counter 208 is released of its reset state each time a signal OK is outputted (COMP being "1"), and begins counting the system clock pulses $\phi$. And, a fresh numerical data is latched in the latching circuit 210 by a carryout output CO which is outputted at each full count of the counter 208.

As a result, from the duration data memory 213, a fresh duration data is read out successively each time a coincidence with the predetermined musical conditions is judged by the judging circuit 214. And, the duration data which is read out from the duration data memory 213 is supplied to an A input terminal of a selector 225. The selector 225 is such that its A input terminal is selected continuously throughout the period until the accumulated value of the respective duration data which are read out from the duration data memory 213 reaches a certain value. For this reason, the respective duration data which are read out from the duration data memory 213 are written in the composition data memory 216 via the selector 225 along with those pitch data whose abovesaid coincidence have been established.

On the other hand, when the accumulated value of those duration data read out from the duration data memory 213 approaches the length of a preset music piece which is, for example, two to four measures, the selector 225 is selected of its B input terminal. Simultaneously therewith, there is inputted to this B input terminal a duration data corresponding to the difference between the length of the preset music piece and said accumulated duration data. As a result, a duration data corresponding to this difference is written, instead of a randomly extracted duration data from the memory 213, in the composition data memory 216 simultaneously with the pitch data in a manner described earlier, thus completing the measure with neither more or less.

Then, a driving signal is supplied to a finish data generating circuit 226, and concurrently this driving signal is supplied also to a count input terminal CK of the address counter 223 via the OR circuits 221 and 222.

As a result, following the write-in of a duration data corresponding to the difference over the length of the predetermined music piece in the composition data memory 216, a finish data (which is, for example, ALL "1") is written in the predetermined final address in the composition data memory.

The above-stated operations are carried out in the following manner. An $A<B$ output (in this example, this signal is "0" when A is smaller than B and "1" when A is equal to or greater than B) of a comparing circuit 227 is supplied to a changeover input terminal SA of the selector 225, and also is supplied, via an inverter 228, to a changeover input SB of this selector 225. As a result, when the condition $A<B$ is established in the comparing circuit 227, the selector 225 is selected of its B input terminal, and in other state, its A input terminal is selected.

To the A input terminal of the comparing circuit 227 is supplied an output of a subtracting circuit 229. On the other hand, to the B input terminal of this comparing circuit 227 is supplied an output of a quarter note duration data generating circuit 230. The quarter note duration data 230 generates a duration data corresponding to a quarter note. The subtracting circuit 229 is assigned to perform a subtracting operation between the duration data corresponding to the length of a predetermined music piece outputted from a finish duration generating circuit 231 and the accumulated duration data stored in a register 232. The output of this subtracting circuit 229 is supplied, in parallel, to the A input terminal of the comparing circuit 227 and to the B input terminal of the selector 225. The respective bits which constitute an output of this subtracting circuit 229 are taken as a negation of their logical sum via a NOR circuit 233. This output of this subtracting circuit 229 drives the finish data generating circuit 226 and the address counter 223.

On the other hand, in the register 232 is latched, in synchronism with said coincidence signal OK, the result of operation of an adding circuit 234. Also, to an A input terminal of said adding circuit 234 are supplied respective duration data which are read out successively from the duration data memory 213. To a B input terminal thereof is supplied the result of operation of the adding circuit 234 per se which is supplied thereto via the register 232. As a result, in the register 232 is stored the accumulated value of the respective duration data which are read out successively from the duration data memory 213. Also, this register 232 is reset by a $\Delta$COMST which is supplied thereto via an OR circuit 235.

Thus the duration data are read out successively from the duration data memory 213, and accordingly the accumulated value in the register 232 approaches the predetermined value which is equal to the whole length of the music piece and is outputted from the finish duration generating circuit 231, and when the residue value becomes less than a quarter note duration, the selector 225 is selected of its B side by an $A<B$ output of the comparing circuit 227. And, a duration data representing the difference over the music piece duration data which difference is the result of subtraction done by the subtracting circuit 229 is written in the composition data memory 216 via the selector 225. Then the result of subtraction done in the subtracting circuit 229 becomes 0 (i.e. all digits are 0's), so that a finish data generating circuit 226 is driven by an output "1" of the NOR circuit 233 as stated above. Accordingly, the address counter 223 advances its count, and a finish data is written in the predetermined final address of the composition data memory 216.

It should be understood here that the length of the musical piece duration data outputted from the finish duration generating circuit 231 can be varied arbitrarily. By its adjustment, it is possible to freely set the length of the desired music piece.

As stated, when the composition start switch $SW_{21}$ is turned on, the pitch data which are read out from the pitch data memory 212, along with those duration data read out successively from the duration data memory 213 after the former having been selected and picked up by the judging circuit, are written successively in the composition data memory 216. And, when the accumulated value of the duration data read out from the duration data memory 213 reaches within the length of a quarter note relative to the length of the preset music piece, there is automatically written in the composition data memory 216 a duration data having a length sufficient for terminating precisely with the preset length of the music piece. That is, by this arrangement, respective pitch data and duration data which jointly constitute a composed music piece are written successively, in parallel respectively, in the respective addresses in the composition data memory 216. And, a finish data is written in the final address.

In FIGS. 6A and 6B, it should be noted that the arrangement for the performing mode operation is altogether identical with that shown in FIGS. 1A and 1B. The switch $SW_{22}$, differentiating circuit 236, RS flip-flop 237, D flip-flop 238, AND circuit 239, duration counter 240, OR circuit 241, CRT controlling circuit 242, printer controlling circuit 243, duration comparing circuit 244, amplifier 245, loudspeaker 246, tempo clock pulse generator 249, AND circuit 250, finish detecting circuit 251, printer 252, CRT 253, music tone forming circuit 254 and OR circuit 255 are identical with those shown in FIG. 1B by reference numerals and symbols $SW_2$, 49, 25, 50, 26, 28, 30, 32, 33, 36, 52, 53, 54, 37, 39, 35, 34, 51 and 29, respectively.

In this third embodiment, arrangement is provided so that: in order to obtain a series of duration data for composing a required music piece, plural kinds of duration data are preliminarily stored in the duration data memory 213; that while these stored duration data are read out (extracted) at random, the apparatus is operative in such a way that when the accumulated value of the duration data that have been read out approaches the length of desired music piece, the duration data corresponding to the remaining length (residue) itself is written in the composition data memory 216. Accordingly, it is possible to unfailingly obtain a series of duration data having the exact length of the desired music piece. Also, by altering in various ways the length of the music piece in the finish duration generating circuit 231, it is possible to freely select the length of the music piece also. That is, if, instead, arrangement is provided so that only duration data are randomly read out from the duration data memory 213, their accumulation may give rise to a length extending beyond the length of the desired music piece, or it may come short of the length of this music piece. Accordingly, in order to solve such inconvenience which could arise, this third embodiment is arranged so that, in case the accumulated value of the respective duration data which are read out from the duration data memory 213 approaches within a certain extent relative to the length of a desired music piece, the write-in of the readout duration data in the composition data memory 216 is prohibited, and that, instead, such particular duration data as will precisely finish at the end of a desired length of music piece is written in the composition data memory 216. By such unique arrangement, it becomes possible for the first time to obtain an arrangement of a series of music notes having a desired length.

In this third embodiment, arrangement is provided so that simultaneously with the writing-in, in the composition data memory 216, of the respective duration data read out successively from the duration data memory 213, those pitch data which have been found to satisfy the preset musical conditions are written, in pair with said duration data, in the composition data memory 216. However, by so arranging that, for example, the respective duration data which are read out from the duration data memory 213 are written in a composition data memory which is for the exclusive use of duration data, and that these data are supplied to a rhythm tone supply in the performing mode operation, it is possible to carry out an automatic performance of a rhythm musical instrument, whereby, in providing a musical education, such apparatus can be effectively utilized in, for example, exercising rhythms. Furthermore, by arranging so that the respective duration data outputted successively from the duration data memory 213 are supplied directly to a rhythm tone supply, it is possible to obtain an automatic performance of rhythm tones as in the case described just above.

Also, in this third embodiment, arrangement is made so that, in order to bring the final data of a series of music tone arrangement pattern data to precisely end with the length of a desired music piece, only the final duration data is amended. However, not only the final duration data of the music piece, but also by arranging so that the register 232 is reset for each measure, it is possible also to obtain a group of a series music note arrangement pattern data such that a marking-off is established for each measure.

Still further, in this third embodiment, among a series of music note arrangement pattern data, duration is amended only of the final duration data. Instead, it is possible also to make a similar marking-off processing of the music piece by means of such processing that an amendment of duration is performed of a duration data provided at a position appropriately before the final duration data, and that for each final duration data, there is added uniformly a quarter note plus a quarter reset note. Especially, as mentioned above, by arranging the final duration data so as to be in agreement with a usual finish pattern as a quarter note plus a quarter reset note, it is possible to make natural with no queerness the sense of termination of the music piece which is composed.

What is claimed is:

1. An apparatus for automatically composing a music piece, comprising:

pitch data memory means storing plural kinds of pitch data representing respective musical note pitches;

extracting means connected to said pitch data memory means for extracting, one after another, pitch data by randomly accessing the stored pitch data;

condition providing means for providing predetermined plural kinds of musical conditions;

judging means supplied with said extracted pitch data and connected to said condition providing means for judging whether each said extracted pitch data satisfies said musical conditions;

deliver-out means connected to said judging means for delivering out, from among said extracted pitch data, only those that satisfy said musical conditions successively in timed sequence; and duration imparting means connected to said deliver-out means for combining each said delivered pitch data with a duration data representing a musical time length to form successively, in timed sequence, composition data as combined pairs of a pitch data and a duration data, thus a timewise alignment of said composition data constituting a music piece.

2. An apparatus according to claim 1, further comprising:

tone forming means supplied with said composition data for forming musical tones each having a pitch and a duration represented by each said composition data.

3. An apparatus according to claim 1, further comprising:

display means supplied with said composition data for displaying said music piece in musical notation based on said composition data.

4. An apparatus according to claim 1, further comprising:

printer means supplied with said composition data for printing out said music piece in musical notation based on said composition data.

5. An apparatus according to claim 1, further comprising:

temporary memory means connected to said deliver-out means and said judging means for temporarily storing a delivered pitch data until the next judgment takes place, and in which said condition providing means provides a musical condition that a pitch data to be delivered out should have a predetermined relation with the pitch data which was delivered out precedingly and is being stored in said temporary memory means.

6. An apparatus according to claim 1, further comprising:

composition data memory means for storing the delivered composition data successively; and a composition read-out means connected to said composition data, memory means for reading out said composition data at a time rate determined by the respective duration data portions of said respective composition data.

7. An apparatus according to claim 1, in which: said duration imparting means comprises:

duration set providing means for providing at least a set of duration data each set being constituted by serially arranged duration data and forming a rhythm pattern; and combining means for combining the respective ones of said serially arranged duration data with the respective ones of said successively delivered pitch data.

8. An apparatus according to claim 7, in which:

said duration set providing means comprises duration data memory means storing plural kinds of duration data representing respective musical time length; and duration data read-out means connected to said duration data memory means for reading out, one after another, duration data by randomly accessing the stored duration data.

9. An apparatus according to claim 7, in which:

said duration set providing means comprises rhythm pattern memory means storing plural kinds of rhythm pattern segments of a predetermined same musical time length, each rhythm pattern segment being a timewise alignment of plural duration data; and pattern read-out means connected to said rhythm pattern memory means for reading out, one after another, rhythm pattern segments by randomly accessing the stored rhythm pattern segments.

10. An apparatus according to claim 1, in which: said condition providing means includes:

condition selecting means for selectively determining musical conditions to be used for said judgment.

11. An apparatus for automatically composing a music piece, comprising:

pitch data memory means storing plural kinds of pitch data representing respective musical note pitches;

extracting means connected to said pitch data memory means for successively extracting the stored pitch data;

condition providing means for providing predetermined plural kinds of musical conditions;

judging means supplied with said extracted pitch data and connected to said condition providing means for judging whether each said extracted pitch data satisfies said musical conditions;

selected data memory means connected to said judging means for storing all of the pitch data which have satisfied said musical conditions;

deliver-out means connected to said selected data memory means for randomly selecting and delivering out one pitch data from among said all of the pitch data stored, whereby the above-mentioned functions of the whole means are repeated to deliver out a plurality of said pitch data in a timewisely aligned fashion.

12. A method of automatically composing a music piece, comprising:

a first step of extracting note pitches, one after another, from among note pitches in a musical scale at random selection;

a second step of predetermining musical conditions to be utilized as criteria for selecting note pitches;

a third step of judging, whether each of the extracted note pitches satisfies the predetermined musical conditions;

a fourth step of selecting, from among the extracted note pitches, only those note pitches that have satisfied the musical conditions;

a fifth step of combining each of the selected note pitches with a note duration to make respective pitch/duration pairs; and a sixth step of aligning said pitch/duration pairs timewisely.

13. A method according to claim 12, in which the musical conditions include a condition that an extracted note pitch should have a predetermined relation swith the precedingly selected note pitch.

14. A method according to claim 12, in which said sixth step includes a first sub-step of storing said pitch-/duration pairs and a second sub-step of reading the pitch/duration pairs at real time intervals respectively represented by the respective note durations.

15. A method according to claim 14, which further comprising:

a seventh step of forming, responsive to the read out pitch/duration pairs, musical tones each having a pitch and a duration designated by each of the read out pitch/duration pairs.

16. A method according to claim 12, which further comprising:

a seventh step of providing a plurality of note durations aligned in timewise series to form a rhythm pattern, the respective note durations being combined with the respective selected note pitches to make the respective pitch/duration pairs in said fifth step.

17. A method according to claim 16, in which:

said seventh step includes a first sub-step of providing plural kinds of rhythm pattern segments each constituted by a timewise alignment of plural note durations and a second sub-step of timewisely connecting the rhythm pattern segments selected randomly from among said rhythm pattern segments, thus forming said rhythm pattern.

* * * * *